US005624313A

United States Patent [19]

Nonaka et al.

[11] Patent Number: 5,624,313

[45] Date of Patent: Apr. 29, 1997

[54] LOUVER

[75] Inventors: Katsuya Nonaka; Toru Koyama, both of Kawasaki, Japan

[73] Assignee: Fujitsu General Limited, Kawasaki, Japan

[21] Appl. No.: 566,171

[22] Filed: Dec. 1, 1995

[30] Foreign Application Priority Data

Oct. 18, 1995 [JP] Japan ..... 7-294811

[51] Int. Cl.[6] ..... F24F 13/075

[52] U.S. Cl. ..... 454/202; 454/313; 454/319

[58] Field of Search ..... 454/313, 315, 454/319, 320, 202

[56] References Cited

U.S. PATENT DOCUMENTS

| | | | |
|---|---|---|---|
| 2,282,572 | 5/1942 | Graham | 454/315 |
| 3,461,791 | 8/1969 | Beyer | 454/315 |
| 4,545,294 | 10/1985 | Dayus | 454/320 |
| 4,607,565 | 8/1986 | Sugawara | 454/319 |
| 5,056,420 | 10/1991 | Komori | 454/315 |

*Primary Examiner*—Henry A. Bennett
*Assistant Examiner*—Derek S. Boles
*Attorney, Agent, or Firm*—Kanesaka & Takeuchi

[57] ABSTRACT

A louver decreasing the total number of required louvers, reducing the manufacturing cost, and obtaining the excellent external appearance. A louver 20 of a device for shifting the wind direction 11 provided at a blast port 83 of a air-conditioner 10 having a first wind rectification surface 21 which is in a plane form, parallel to the blast direction, and a second wind rectification surface 22 which is in the plane form, positioned in a parallel state to the first wind rectification surface 21, and connected in a stair form by a difference of elevation surface 23, and is positioned so that the difference of elevation surface 23 faces the blast source at a slant.

10 Claims, 7 Drawing Sheets

LOUVER

BACKGROUND OF THE INVENTION

1. Field of the Invention

The present invention relates to a louver, and, to be more precise, relates to a louver applied as a device for shifting the wind direction provided at a blast port of, for example, an air-conditioner and so on.

2. Description of Related Art

FIG. 8 illustrates a unified type of an air-conditioner 80. This air-conditioner 80 receives an indoor unit and outdoor unit in a body 81 in a box-shaped form, and is installed by inserting the body 81 into a space created, for example, an opening in the wall surface of a building.

This air-conditioner 80, wherein the front cover is attached at the front part of the body 81 so as to be attachable and removeable, sends the attemperation air such as cool air, warm air, and so on, from a blast port 83 provided at the front cover to the inside of a room, after conducting the thermal conversion of the indoor air sucked from a suction port 82 provided at the front cover inside of the body 81.

At the suction port 82, a grille 85 wherein a number of raised portions 84 are formed is provided. The raised portion 84 is formed in a flat form of a virtually rectangular plane, and a number of the raised portions 84 are positioned so that the longitudinal direction is along, in the directon of the width of (in the drawing, the right-and-left direction), the body 81.

These raised portions 84 are formed as part of the above-described front cover, and are positioned in a parallel state to each other in the direction of the width and in the direction of the height of the body 81 at a predetermined interval.

Meanwhile, at the blast port 83, a device for shifting the wind direction 88, omprising a number of mobile cross louvers 86 and longitudinal louvers 87, is provided to change the blast direction of the attemperation air.

There, the cross louver 86 is positioned along, in the direction of the width of, the body 81 in order to change the blast direction of the attemperation air up-and-down, and the longitudinal louver 87 is positioned along, in the direction of the height of, the body 81 in order to change the blast direction of the attemperation air right-and-left.

As FIG. 9 illustrates, the cross louver 86 and the longitudinal louver 87 is made to be a flat form of a virtually rectangular plane, and a support axis 89 is formed at both of the longitudinal ends.

The cross louver 86 has the longitudinal dimension corresponding to the inside width dimension of a frame part 88A (refer to the chained line of two dots, in the drawing) provided on the front cover. These cross louvers 86 are positioned in a parallel state in the direction of the height of the frame part 88A at a predetermined interval, and are supported by the frame part 88A in order to be turned around the support axis 89.

Meanwhile, the longitudinal louver 87 has the longitudinal dimension corresponding to the internal height dimension of the blast opening (not illustrated in the drawing) provided at the body 81. These longitudinal louvers 87 are positioned in a parallel state in the direction of the width of the blast opening at a predetermined interval, and are supported by the body 81 in order to be turned around the support axis 89.

The device for shifting the wind direction 88, wherein each cross louver 86 and each longitudinal louver 87 are made to interlock by a link motion which is not illustrated in the drawing, changes the blast elevation angle by turning each cross louver 86, and changes the blast swing angle by turning each longitudinal louver 87.

In the device for shifting the wind direction 88, the cross louver 86, extending in the direction of the width of the body 81, is positioned at the room side, and the longitudinal louver 87 is positioned at the internal side of the body 81 in order to achieve the external unification with the grille 85 wherein the raised portions 84 are formed along, in the direction of the width of, the body 81 (refer to FIG. 8).

The above-described device for shifting the wind direction 88, wherein a number of cross louvers 86 and longitudinal louvers 87 are required, has a problem of requiring a large number of louvers, therefore increasing the manufacturing cost.

For this reason, the louver, wherein a plurality of supplementary longitudinal wings in a virtual doglegged form are provided on both the front and back faces, has been proposed in recent years (Refer to Japanese Utility Model Application Laid-open No. 59-191544 official report: Prior embodiment).

According to this prior embodiment, a longitudinal louver is eliminated since the supplementary longitudinal wing functions as a longitudinal louver, which changes the blast swing angle when the louver is positioned as a cross louver, and therefore the total number of required louvers is reduced.

However, the louver of the prior embodiment, wherein a plurality of supplementary longitudinal wings are provided on both the front and back faces, gives the impression that the louver and the supplementary wings are combined in a virtual grid state, and has a problem of the excellence of the external appearance being reduced.

Especially when this louver is positioned at the blast port 83 of the above-described air conditioner 80, the uniformity in external appearance with the grille 85 is not attained, and there is concern that the excellence of the external appearance of the air conditioner 80 may be marred.

This prior embodiment, wherein a plurality of supplementary longitudinal wings are provided in the louver, requires a complicated form of a metallic mold, and more resin compared to the louver with the flat form in order to form the louver, and has a problem of having high manufacturing costs.

Furthermore, the louver of the prior embodiment has had the problem of generating resonance, which is a so called trembling sound, when the attemperation air is sent faster than the predetermined speed.

These above-described problems occur not only to the louver provided at the blast port of the unified type of air-conditioner, but also to the louver provided at the blast port of a separate type of air-conditioner wherein the outdoor unit and indoor unit are separated, and to the louver and so on provided at the blast port of an air-cleaner installed indoor.

The present invention is made in order to solve these conventional problems, and its object is to provide the louver which reduces the total number of the required louvers and the manufacturing cost, and obtains excellence in its external appearance.

SUMMARY OF THE INVENTION

In order to attain the above-described object, the invention described in claim 1 of the present invention is a louver for changing the blast direction, and comprises a first wind rectification surface in a plane form which is in a parallel state to the above-described blast direction, and a second wind rectification surface in the plane form which is positioned in a parallel state to the above-described first wind rectification surface and is connected in a stair state by a difference of elevation surface, which is positioned as to face the blast source at a slant.

In this case, it is fine if the louver is formed in the flat form of a virtually rectangular plane like the conventional louver, and if the front of the louver is formed in a virtual crank form, or in a virtual trapezoid form, by, for example, providing the difference of elevation surface along the line which crosses the longitudinal direction.

In order to make the difference of elevation surface face the blast source at a slant, it is fine if at least one of the first wind rectification surfaces or second wind rectification surfaces is provided across the direction which crosses the longitudinal direction of the louver and the other of the first wind rectification surface or second wind rectification surface is positioned so as to be a convex surface to the other one.

These louvers are formed by the appropriate manufacturing methods such as a mold forming, press forming, cutting forming, and so on of the resin, metal, and wood and so on.

In the invention described in claim 1 of the present invention described above, when the louver is positioned at the blast port, for example, of the air conditioner, the attemperation air is guided along the difference of elevation surface, and the blast direction is changed.

That is to say, in the invention described in claim 1 of the present invention, wherein the difference of elevation surface functions as a cross louver, or a longitudinal louver, the blast elevation angle and the blast swing angle are changed even if the cross louver, or the longitudinal louver is eliminated, having the same effect, that the total number of required louvers is reduced, as obtained by the conventional louver.

In the invention described in claim 1 of the present invention, wherein the difference of elevation surface is provided between the first wind rectification surface and the second wind rectification surface, the external appearance of the louver seen from the direction of facing the blast, becomes, for example, a virtual crank form, or a virtual trapezoid front form, and the external appearance which closely resembles the louver in a flat form is obtained.

Moreover, this louver, wherein only the difference of elevation surface is provided between the first wind rectification surface and the second wind rectification surface, does not require the complicated form of the metallic mold and a large amount of material when manufactured.

Furthermore, in the invention described in claim 2, wherein the edge lines where the difference of elevation surface crosses the first wind rectification surface and the second wind rectification surface is in a plane arc form, the difference of elevation surface is formed as an arc surface. Accordingly, the blast direction of the attemperation air is smoothly changed, compared to the difference of elevation surface formed in the flat form, and there is less fear of a turbulent eddy flow being generated.

In the invention described in claim 3, wherein the difference of elevation surface is vertical to the first wind rectification surface, and the second wind rectification surface, a fear of the attemperation air guided along the difference of elevation surface deviating from the difference of elevation surface to the first wind rectification surface or the second wind rectification surface is lessened, and the blast direction is surely changed.

In the invention described in claim 4, wherein a plurality of the difference of elevation surfaces are provided, the total amount of the attemperation air which blast direction can be changed is increased, or the blast direction is changed so as to widen the range of the attemperation air.

Meanwhile, in the invention described in claim 5, wherein the difference of elevation surfaces are provided on both front and back faces, the blast direction is efficiently changed, compared to the louver wherein the difference of elevation surface is provided on only one face.

Further, in the invention described in claim 6, wherein the wall thickness is virtually even, a large amount of resin is not required, compared to the louver in the flat form, for example, when the resin forming of the louver is conducted, and the manufacturing cost does not become high.

The invention described in claim 7 wherein the above-described second wind rectification surface provided on the above-described front face and the first wind rectification surface provided on the above-described back face are positioned on the same surface.

In this invention described in claim 7, wherein the dimension in the direction of the thickness of the louver is shortened, even if the difference of elevation surfaces are provided on both front and back faces, the external appearance closely resembling the louver in the flat form is obtained.

Further, the invention described in claim 8 is in a face symmetry form about the surface along, in the direction of the thickness of, the louver and the above-described blast direction.

In this case, it is fine if the louver is in a line symmetry form seen from the front, by forming the first wind rectification surface in the face symmetry form about the surface which is along the direction of the thickness of the louver and the blast direction, and by connecting a pair of the second wind rectification surfaces in the face symmetry form to the face symmetry position by this first wind rectification surface.

In this invention described in claim 8, a pair of the difference of elevation surfaces are positioned in face symmetry, if, for example, the first wind rectification surface is made in the face symmetry form, in order to make the louver in the face symmetry form.

Accordingly, when the louver is positioned so as to change the blast elevation angle of, for example, cool air, warm air, and so on, the blast swing angle of cool air, warm air, and so on is changed so as to be divided, and the excellence in design is obtained.

The invention described in claim 9, which turns around the support axis extending to the direction which crosses the above-described blast direction, changes the blast direction of the attemperation air to a three-dimension direction.

Then, in the invention described in claim 10, which is positioned at the blast port of the air conditioner, the uniformity in the external appearance with the grill positioned at the suction port of, for example, the air conditioner is obtained, indoor air conditioning is conducted efficiently, and therefore, the above-described object is attained.

DETAILED DESCRIPTION OF THE PREFERRED EMBODIMENT(S)

Figure 8:
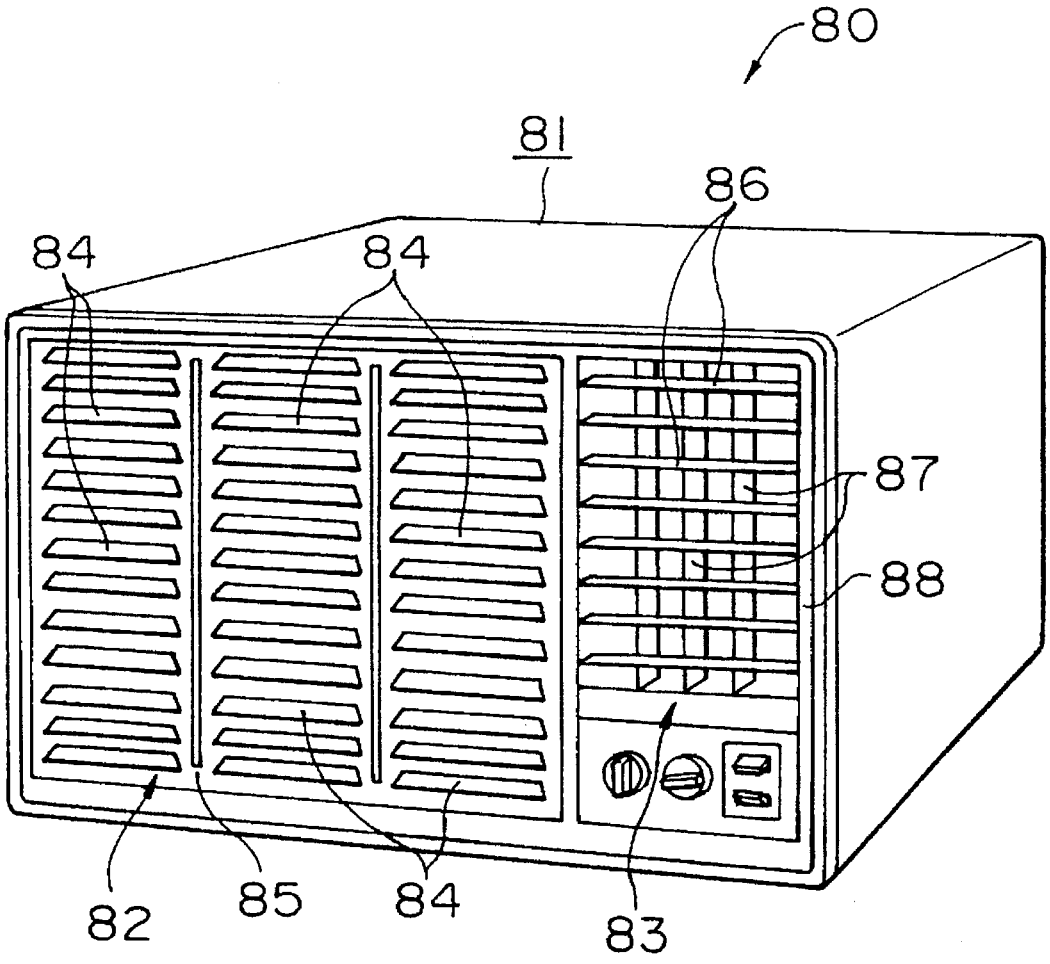
FIG. 8 is a general perspective view of the appearance of the air-conditioner.
Figure 9:
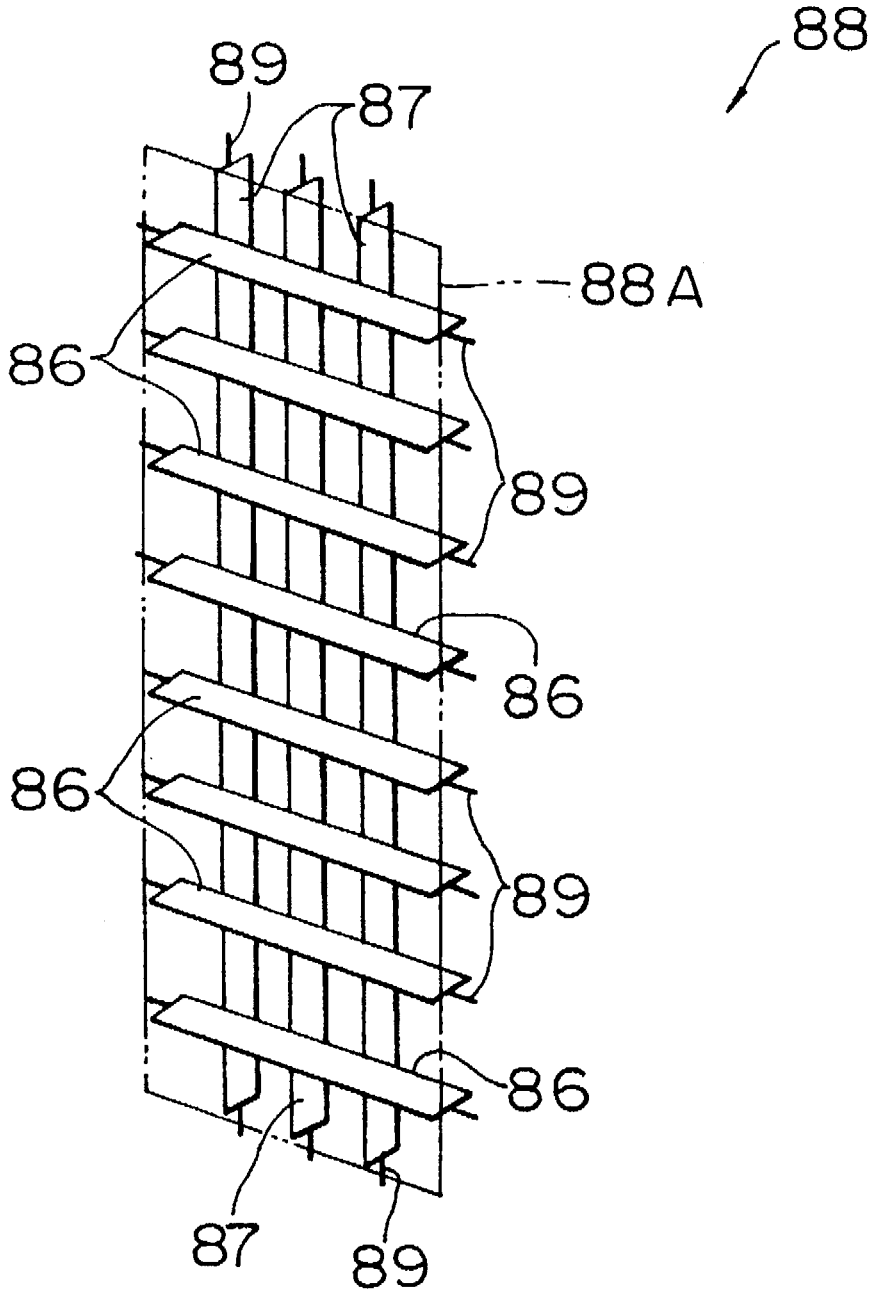
FIG. 9 is a type perspective view of the appearance of the structure of the conventional louver.

A preferable embodiment of the present invention is now described with reference to the drawings. It is mentioned that in each embodiment described below, the explanation about the elements which have been already described in FIG. 8 and FIG. 9 is simplified or abbreviated using identical numbers in the drawings.

FIRST EMBODIMENT

Figure 1A:
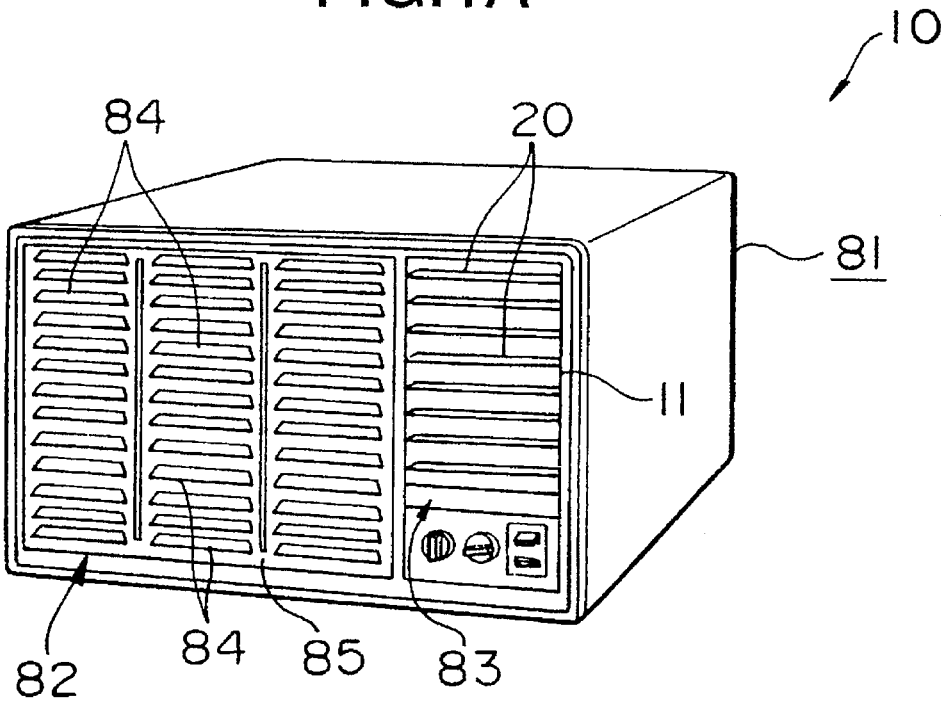
FIG. 1A and FIG. 1B are a general perspective view, and a perspective view of the essential part.

FIG. 1A and FIG. 1B, and FIG. 2A and FIG. 2B illustrate the first embodiment related to the present invention. As FIG. 1A illustrates, an air-conditioner 10 of the present embodiment is provided with a grill 85 wherein numerous of raised portions 84 are formed at a suction port 82, and with a device for shifting the wind direction 11 including numerous louvers 20 which are movable at a blast port 83.

The raised portion 84 and the louver 20 are formed to be plates which are virtually rectangular planes, and many are positioned so that each longitudinal direction is along, in the direction of the width (in the drawing, the right and left direction) of, a body 81.

The louver 20 is positioned within a frame part (not illustrated in the drawing) provided on a front cover of the body 81 so that the longitudinal direction of the louver 20 intersects a blast direction of the attemperation air sent from the blast port 83.

Figure 1B:
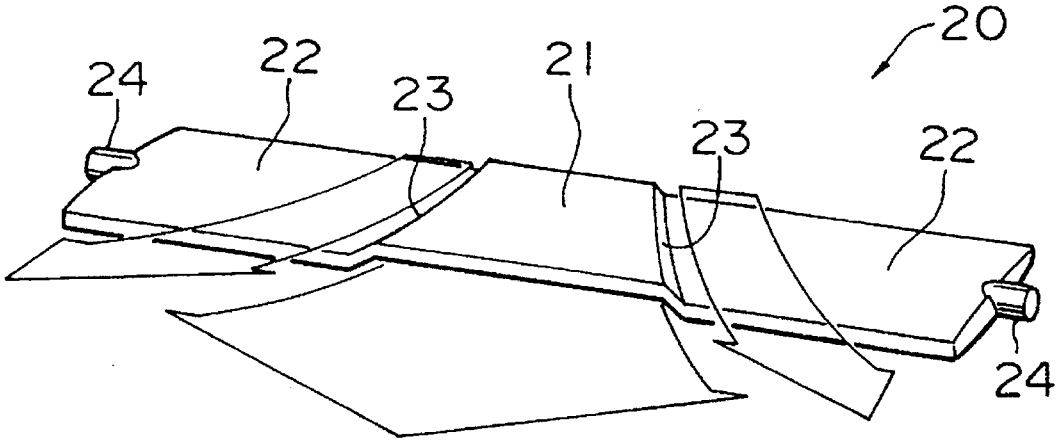
Figure 2A:
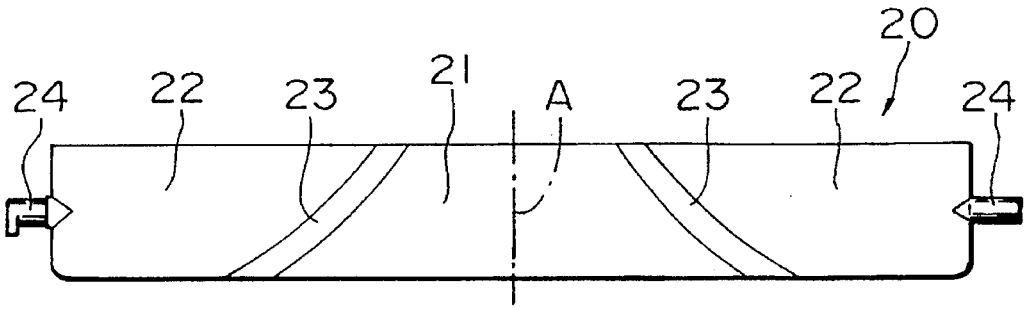
FIG. 2A and FIG. 2B are a plane view and a front view of the appearance of the above-described embodiment.
Figure 2B:
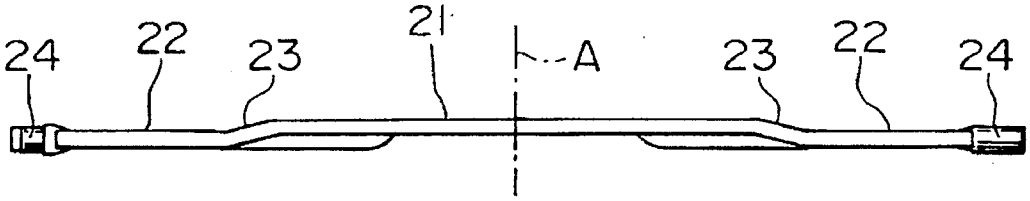

As FIG. 1B and FIG. 2A and 2B illustrate, each louver 20 has the first wind rectification surface 21, which is in a plane form positioned in the center, and second wind rectification surfaces 22 and 22 which are in the plane form positioned in a parallel state to and connected in a stair state to the first wind rectification surface 21. The first wind rectification surface 21 is made to be virtually a trapezoid plane in a face symmetry form (refer to FIG. 2A). Meanwhile, the second wind rectification surfaces 22 and 22 are respectively connected to both the longitudinal ends of the first wind rectification surface 21 of the louver 20 by difference of elevation surfaces 23 and 23. These second wind rectification surfaces 22 and 22 are made to be in a face symmetry form to each other, and support axes 24 and 24 are respectively provided at the positions equivalent to both of the longitudinal ends of the louver 20.

This louver 20 is in the face symmetry form about the surface (refer to the chain line A in FIG. 2A) which is along, in the direction of the thickness and the blast direction of, the louver 20, and the frontal external appearance closely resembles that of a flat louver, so that the uniformity in design is achieved without any incompatibilities.

The edge lines where the first wind rectification surface 21 meet the second wind rectification surfaces 22 and 22 are made to be an arc plane, and therefore, the difference of elevation surfaces 23 and 23 obliquely face the blast source of the attemperation air, and become arc surfaces which curve from the blast port to the blast destination.

This louver 20 has the longitudinal dimension corresponding to the inside width dimension of the above-described frame part and a virtually even wall thickness dimension, and the first wind rectification surface 21, the second wind rectification surfaces 22 and 22, the difference of elevation surfaces 23 and 23, and the support axes 24 and 24 are formed in one united body by the mold forming of resin and so on.

Returning to FIG. 1A, these louvers 20 are positioned in a parallel state to one another in the height direction at predetermined intervals, so that the axes 24 and 24 face the direction which intersects the blast direction.

These louvers 20 are made to revolve on the support axes 24 and 24, and are made to interlock one another by a link motion which is not illustrated in this embodiment.

As FIG. 1 illustrates, in the above-described device for shifting the wind direction 11, most of the attemperation air going straight onto the louver 20 is rectified along the first wind rectification surface 21 and the second wind rectification surface 22 and goes straight on, and the rest of the attemperation air is rectified along a pair of the difference of elevation surfaces 23 and 23 widening the range, and changing the swing angle of the blast.

When each louver 20 turns, the attemperation air is rectified along the first wind rectification surface 21 and the second wind rectification surface 22, to change the blast elevation angle, and, with this, the blast elevation angles of cool air and warm air along the deference of elevation surfaces 23, and 23 are changed.

It is mentioned that the louver 20 in the present embodiment is positioned as a cross louver mainly for changing the blast elevation angle of the attemperation air, but the louver 20 does not prevent a longitudinal louver from being used.

Since the above-described louver 20 of the present embodiment changes the blast elevation angle and the blast swing angle, the same effect of decreasing the total number of louvers required as the conventional louver is obtained.

Meanwhile, the louver 20 of the present embodiment, wherein the difference of the elevation surfaces 23 and 23 are provided between the first wind rectification surface 21 and the second wind rectification surface 22 in order to change the blast elevation angle and the blast swing angle of the attemperation air, an external appearance closely resembling the flat louver is obtained. Accordingly, the excellence in the external appearance is not reduced, compared to the louver wherein a supplementary longitudinal wing has been conventionally provided, and the uniformity in the external appearance with the grille 85 wherein numerous raised portions 84 are formed is obtained, so that there is no fear that the excellence in the external appearance of the air-conditioner 10 will be marred.

The louver 20, wherein only the difference of elevation surfaces 23 and 23 are provided between the first wind rectification surface 21 and the second wind rectification surface 22 does not require a complicated form of a metal mold and a large amount of material when manufactured, therefore the manufacturing costs are reduced compared to those of the conventional louver.

The louver 20 of the present embodiment does not cause resonance, which is caused by the louver wherein the supplementary longitudinal wing is provided, when the attemperation air is sent at a speed faster than the predetermined speed, and quietness is obtained.

Moreover, the difference of elevation surfaces 23 and 23 of the louver 20, wherein the edges line where the difference of elevation surfaces 23 and 23 meet the first wind rectification surface 21 and the second wind rectification surface 22, are an arc surface which is in the plane arc form, the blast direction of the attemperation air is changed smoothly, compared to the case when the difference of elevation surface is formed in the flat form, and there is less fear of a turbulent eddy flow and so on being generated.

The louver 20, wherein a plurality of the difference of elevation surfaces 23 and 23 are provided, changes the blast swing angle of a large amount of attemperation air, and sends the attemperation air in a way as to widen the range of the attemperation air.

Since the wall thickness of the louver 20 is virtually even, the required resin volume for mold forming does not extremely increase, compared to the louver in the flat form, and the manufacturing cost does not become high.

Furthermore, the louver 20, which has the face symmetry form about the surface along the thickness direction and the blast direction, changes the blast swing angle of the attemperation air so as to divide the blast swing angle equally, and has an excellent front form appearance.

The louver 20, which turns on the support axes 24 and 24, changes the attemperation air to be three-dimensional.

In the present embodiment, wherein the above-described louver 20 is positioned at the blast port 83 of the air-conditioner 10, indoor air-conditioning is conducted efficiently.

Next, the second embodiment to the fifth embodiment related to the present invention are described. It is mentioned that in each embodiment described below, the explanation about the elements already described in the first embodiment is simplified or abbreviated using identical numbers in the drawings.

SECOND EMBODIMENT

Figure 3:
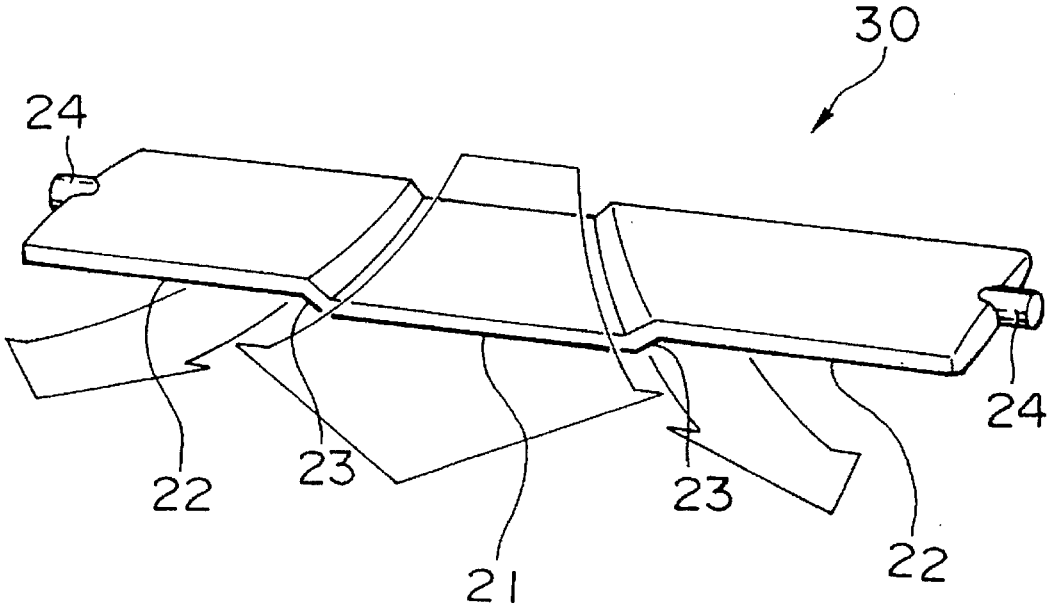
FIG. 3 is a general perspective view of the appearance of the second embodiment of the present invention.

A louver 30 of the second embodiment illustrated in FIG. 3, is the louver 20 illustrated by the examples in the above-described first embodiment with its front and back being reversed.

Accordingly, the louver 30 of the present embodiment obtains the same effect as the louver 20 as illustrated by the examples in the first embodiment.

THIRD EMBODIMENT

Figure 4:
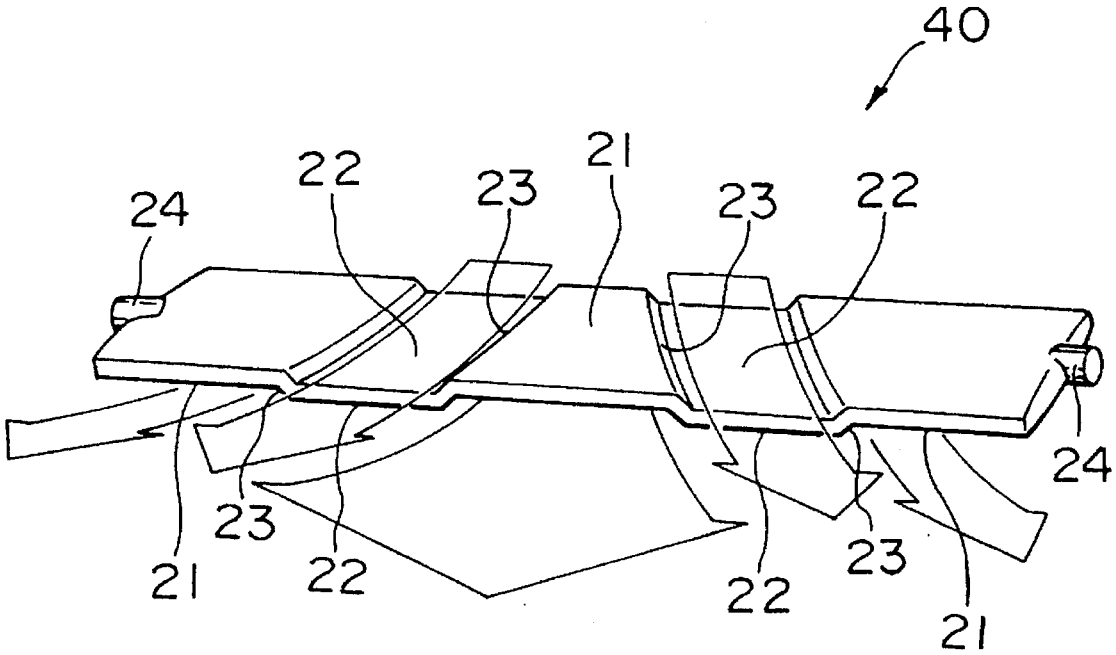
FIG. 4 is a general perspective view of the appearance of the third embodiment of the present invention.

A louver 40, of the third embodiment illustrated in FIG. 4, has the first wind rectification surface 21 and the second wind rectification surface 22 respectively provided at the front face and the back face; therefore a plurality of the difference of elevation surfaces 23 are respectively provided at the front face and the back face.

In this louver 40, the second wind rectification surface 22 provided on the front face (in the drawing, the upper face), and the first wind rectification surface 21 provided on the back face (in the drawing, the lower face) are positioned on the same surface.

According to the above-described embodiment, the louver 40 is basically arranged in virtually the same way as the above-said louvers 20, and 30; therefore virtually the same effect as with the louver 20, and 30 is obtained.

Meanwhile, the louver 40 of the present embodiment, wherein the difference of elevation surfaces 23 are provided on both front face and back face, changes the blast direction more efficiently compared to the louver wherein the difference of elevation surfaces are provided only on one face.

The louver 40, wherein the second wind rectification surface 22 provided on the front face and the first wind rectification surface 21 provided on the back face are positioned on the same surface, the length in the thickness direction is shortened; therefore the external appearance which closely resembles the louver in the flat form is obtained.

FOURTH EMBODIMENT

Figure 5:
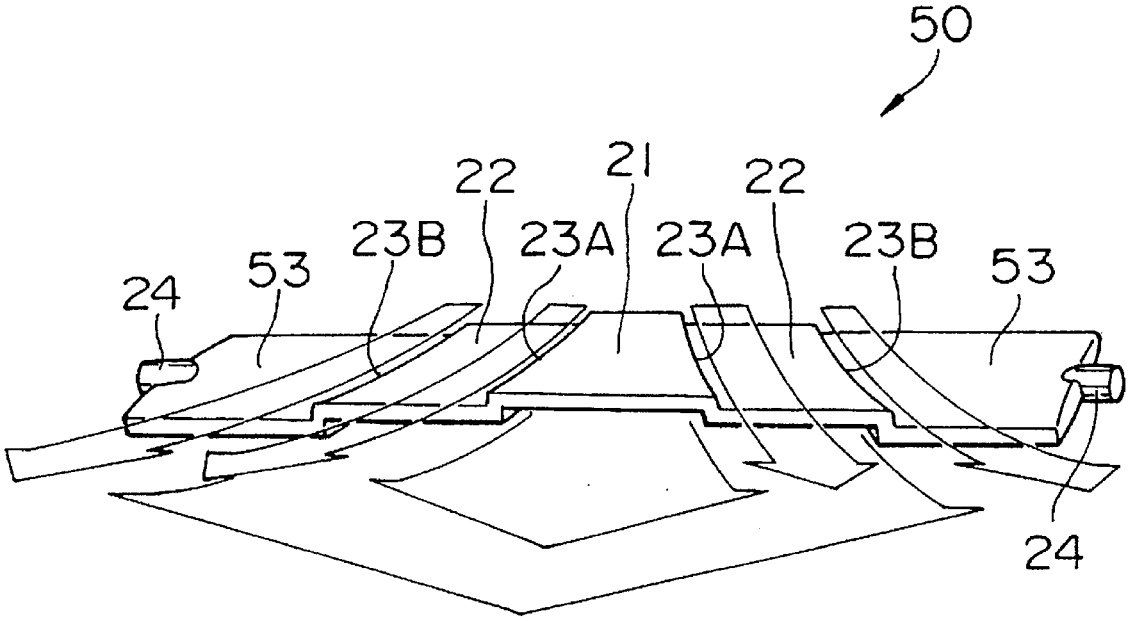
FIG. 5 is a general perspective view of the appearance of the fourth embodiment of the present invention.

In a louver 50 of the fourth embodiment illustrated in FIG. 5, the second wind rectification surfaces 22, and 22 are connected to the first wind rectification surfaces 21 by difference of elevation surfaces 23A, and 23A, and third wind rectification surfaces 53, and 53 are connected to the first wind rectification surface 21 and the second wind rectification surface 22, and 22 by a difference of elevation surfaces 23B, and 23B.

These difference of elevation surfaces 23A, and 23B are respectively provided in a virtually vertical state to the first wind rectification surface.

The above-described embodiment, wherein the louver 50 is basically arranged in virtually the same way as the above-described louvers 20, 30, and 40, virtually the same effect is obtained as with the louvers 20, 30, and 40.

Meanwhile, in the louver 50 of the present embodiment, wherein the difference of elevation surfaces 23A, and 23B are respectively provided in a virtually vertical state to the first wind rectification surface 21, the second wind rectification surface 22, and the third wind rectification surface 53, there is less fear of the attemperation air deviating from the difference of elevation surface 23 to the first wind rectification surface 21, the second wind rectification surface 22, or the third wind rectification surface 53, and the shift of the blast direction is reliably conducted.

FIFTH EMBODIMENT

Figure 6:
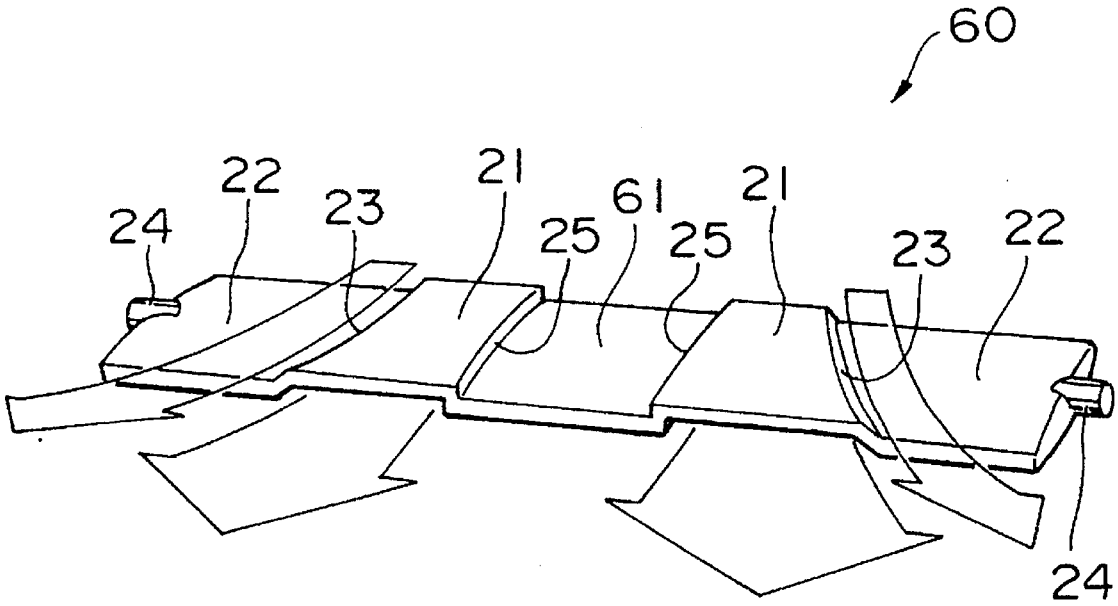
FIG. 6 is a general perspective view of the appearance of the fifth embodiment of the present invention.

In a louver 60 of the fifth embodiment illustrated in FIG. 6, the second wind rectification surfaces 22, and 22 are respectively connected to a pair of the first wind rectification surfaces 21, and 21 by the difference of elevation surfaces 23, and 23.

A concave 61 is provided between each of the first wind rectification surfaces 21, and 21 by the difference of elevation surfaces 25, and 25 which are parallel to the blast direction, and are virtually vertical to the first wind rectification surface 21, and the second wind rectification surface 22.

The above-described embodiment, wherein the louver 60 is basically arranged in virtually the same way as the above-described louvers 20, 30, 40, and 50, virtually the same effect as with the louvers 20, 30, 40, and 50 is obtained.

Meanwhile, the louver 60 of the present embodiment, wherein the difference of elevation surfaces 25, and 25 provided between a pair of the first wind rectification surfaces 21, and 21, not only changes the blast swing angle of the attemperation air, but also rectilinearly send the attemperation air by the difference of elevation surfaces 25, and 25; therefore the attemperation air is sent to a wide range.

It is to be understood that the present invention is not intended to be limited to each of the above-described embodiment, and various improvements, changes, and so on are also included in the scope of the present invention, without departing from the spirit of the present invention. For example, a form of the louver, other than the example forms illustrated in FIG. 7A, FIG. 7B, and FIG. 7C may also be adopted.

Figure 7A:
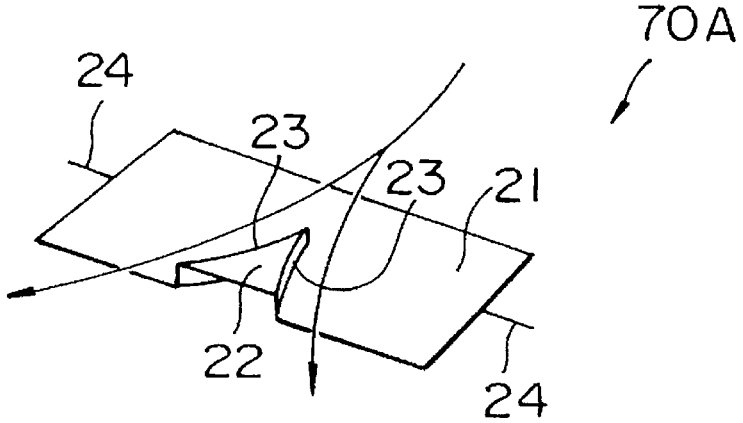
FIG. 7A, FIG. 7B, and FIG. 7C are type perspective views of the modification.

That is to say, in a louver 70A illustrated in FIG. 7A, the second wind rectification surface 22 in the plane form which is tapering to the blast source is provided on the first wind rectification surface 21 in a virtually flat form, and a pair of the difference of elevation surfaces 23, and 23 are respectively provided so as to face the blast port on a slant.

Figure 7B:
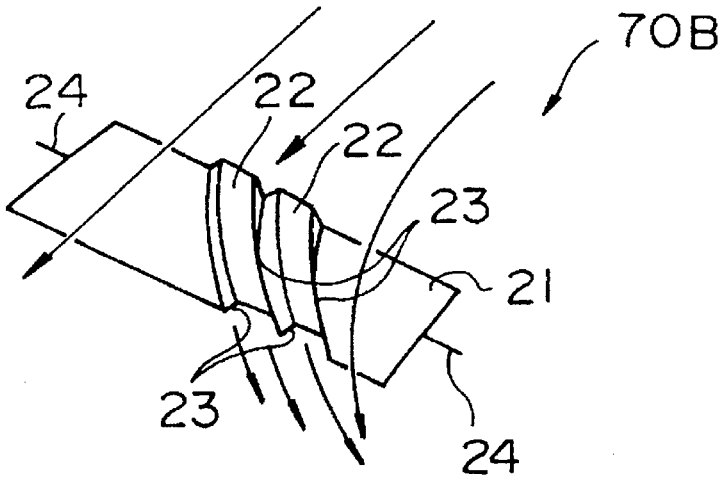

In the louver 70B illustrated in FIG. 7B, a plurality of the second wind rectification surfaces 22 are provided by forming the part of the first wind rectification surface 21 which is in the virtually flat form, into a corrugated plate form, and the difference of elevation surfaces 23 which become the arc surface are respectively provided in a parallel state to one another so as to face the blast source on a slant.

Figure 7C:
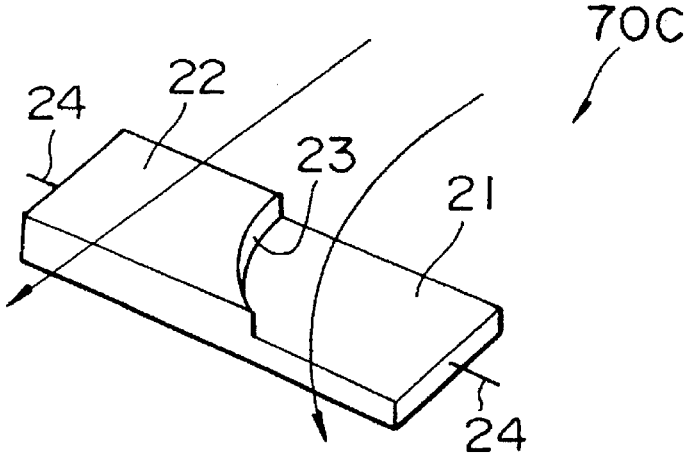

Furthermore, a louver 70C illustrated in FIG. 7C is formed so that the first wind rectification surface 21 and the second wind rectification surface 22 are connected by the difference of elevation surface 23 by conducting a cutting processing only in one surface of the plate material having the predetermined thickness.

With the use of the above-described louvers 70A to 70C, the same effect as with each of the above-described embodiments is obtained.

As material of the louver, resin, metal, wood, and so on can be selected, and the formation may be done by mold forming, press forming, cut forming and so on.

Furthermore, although, in each of the above-described embodiments, the louver of the present invention is applied as the device for shifting the wind direction provided at the blast port of the unified type of air-conditioner which body is installed by being inserted in a space created on the wall surface, the louver of the present invention can be positioned in the separate type of air-conditioner of which indoor unit and outdoor units are separated, or at the blast port of an air cleaner installed indoor, or at the blast port to ventilate the inside of vehicles, automobiles and so on.

Though, in each of the above-described embodiments, the louver of the present invention is illustrated as the cross louver which mainly changes the blast elevation angle of the attemperation air, the louver of the present invention is also applicable as a longitudinal louver.

The forms, sizes, shapes, quantities, points of positioning, and so on, of the louver, the first wind rectification surface, the second wind rectification surface, the difference of elevation surface and so on described in each of the above-described embodiments, within the meaning and range of the present invention are optional and not restrictive.

By applying the invention described in claim 1 of the present invention, the excellent appearance is obtained, while the effect that the total number of required louvers decreases is maintained, and the manufacturing cost is reduced since a complicated form of a metallic mold in a complicated form, and a large amount of material are not required in the manufacturing.

Furthermore, in the invention described in claim 2, wherein edge lines where a difference of elevation surface meet a first wind rectification surface and a second wind rectification surface are an arc surface which is in a plane arc form, a blast direction of the attemperation air and so on is smoothly changed, and there is less fear of a turbulent eddy flow and so on being generated, compared to the difference of elevation surface formed in a flat form.

In the invention described in claim 3, wherein the difference of elevation surface is vertical to the first wind rectification surface and the second wind rectification surface, there is less fear of the attemperation air deviating from the difference of elevation surface to the first wind rectification surface or the second wind rectification surface, and the blast direction is surely changed.

In the invention described in claim 4, wherein a plurality of the difference of elevation surfaces are provided, the total amount of attemperation air and so on which changes blast direction increases, or the blast direction is changed so as to widen the blast range.

Meanwhile, in the invention described in claim 5, wherein the difference of elevation surfaces are provided on both front and back surfaces, the blast direction is changed more efficiently, compared to the case where the difference of elevation surface is provided on only one surface.

Furthermore, in the invention described in claim 6, wherein the wall thickness dimension is virtually even, the required resin volume does not increase extremely, compared to the louver in the flat form even when the resin forming is conducted, and the manufacturing cost does not become high.

In the invention described in claim 7, wherein the second wind rectification surface provided on the front face and the first wind rectification surface provided on the back face are positioned on the same surface, the length in the thickness direction is shortened, and the external appearance closely resembling the ordinary louver is obtained.

Furthermore, in the invention described in claim 8, which is in a face symmetry form about the surface along the thickness direction and the blast direction, the blast direction is changed so as to divide the cool air, warm air, and so on equally.

In the invention described in claim 9, which turns, the blast direction of the cool air, warm air, and so on is changed to be a three-dimensional direction.

By the invention described in claim 10, the uniformity in the external appearance with the grille positioned at the suction port of the air conditioner can be obtained, and the indoor air-conditioning can be done efficiently.

What is claimed is:

1. A louver for changing the blast direction comprising:

a first wind rectification surface which is in a plane form parallel to the blast direction; and a second wind rectification surface which is in the plane form positioned in a parallel state to said first wind rectification surface, to which said second wind rectification surface is connected in a stair state by a difference of elevation surface, which is positioned so as to face the blast source on a slant.

2. The louver according to claim 1, wherein edge lines where the difference of elevation surface meet said first wind rectification surface and said second wind rectification surface is in a plane arc form.

3. The louver according to claim 1, wherein the difference of elevation surface is vertical relatively to said first wind rectification surface and said second wind rectification surface.

4. The louver according to claim 1, wherein a plurality of the difference of elevation surfaces are provided.

5. The louver according to claim 4, wherein the difference of elevation surfaces are provided on both front and back faces.

6. The louver according to claim 5, wherein the wall thickness is even.

7. The louver according to claim 6, wherein said second wind rectification surface provided on the above-described front face, and said first wind rectification surface provided on the above-described back face are positioned on the same surface.

8. The louver according to claim 4, wherein said louver is in a face symmetry form about the surface along, in the direction of the thickness of, the louver and the above-described blast direction.

9. The louver according to claim 1, wherein said louver turns around a support axis extending to the direction which crosses the blast direction.

10. The louver according to claim 1, wherein said louver is positioned at a blast port of an air conditioner.

* * * * *